United States Patent [19]

Kolgan et al.

[11] Patent Number: 4,991,664

[45] Date of Patent: Feb. 12, 1991

[54] COMPRESSION-VACUUM PERCUSSIVE ACTION MACHINE

[76] Inventors: Jury N. Kolgan, Planernaya, 14, korpus 2, kv.13; Nikolai M. Kirjushin, Kolomensky proezd, 3, korpus 1, kv. 63, both of, Moscow; Ivan A. Prokhorov, ulitsa Smuryakova, 9, kv. 48, oblast, Ivanteevka, Moskovskaya; Vitold A. Kezik, ulitsa Stradnieku, 99, kv. 54; Evgeny I. Ryabokon, ulitsa Sarkanarmiyas, 186, kv. 40, both of Latviiskaya SSR, Daugavpils, all of U.S.S.R.

[21] Appl. No.: 474,739

[22] PCT Filed: Aug. 9, 1989

[86] PCT No.: PCT/SU89/00205

§ 371 Date: Apr. 9, 1990

§ 102(e) Date: Apr. 9, 1990

[87] PCT Pub. No.: WO90/01612

PCT Pub. Date: Feb. 22, 1990

[30] Foreign Application Priority Data

Aug. 9, 1988 [SU] U.S.S.R. ..... 4471996

[51] Int. Cl.[5] ..... B25D 9/26; B25D 11/12; F21C 37/24

[52] U.S. Cl. ..... 173/116; 173/123

[58] Field of Search ..... 173/14, 116, 49, 123; 74/603, 53

[56] References Cited

U.S. PATENT DOCUMENTS 4,222,443 9/1980 Chiomy ..... 173/116

FOREIGN PATENT DOCUMENTS 2251247 5/1972 Fed. Rep. of Germany .
2407879 8/1975 Fed. Rep. of Germany .
71768 12/1960 U.S.S.R. .
2726214 12/1978 United Kingdom .
2138729 10/1984 United Kingdom .

*Primary Examiner*—Paul A. Bell
*Assistant Examiner*—Scott A. Smith
*Attorney, Agent, or Firm*—Burgess, Ryan & Wayne

[57] ABSTRACT

A compression-vacuum percussive action machine has a housing (1) which accommodates a cylinder (2) containing a hammer (7) and a piston (3) separated from the hammer (7) by an air cushion (8), a crank (5) connected to the piston and linked with a drive shaft (6) by a counterweight (10) whose center of mass is offset relative to a straight line (A—A) connecting the points of intersection of the axes ($O_1$ and $O_2$) of the drive shaft (6) and crank (5) with a plane perpendicular to the axis ($O_1$) of the drive shaft (6). The projection of the counterweight (10) plotted on this plane is defined by a shape having two portions (12, 13) of which one (12) is symmetrical with the straight line. (A—A) passing through the points of intersection of the axes ($O_1$ and $O_2$) of the drive shaft (6) and crank (5) with a plane perpendicular to the axis ($O_1$) of the drive shaft (6), whereas the center of mass (b) of the other portion (13) rests at a line (B—B) turned relative to said straight line (A—A) in a direction ($\omega$) of rotation of the crank (5) to an angle ($\beta$) of 45°-90°. Masses $m_1$ and $m_2$ of the portions (12, 13) of the counterweight (10) corresponding to these portions of the shape are determined by the relationship:

$$m_1 r_1 = \frac{m_2 r_2}{K}$$

where $r_1$ and $r_2$ are the distances from the point of intersection of the axis ($O_1$) of the drive shaft (6) with a plane perpendicular to this axis to the centers of mass (a, b) of the portions (12, 13) of the counterweight (10) with the respective masses $m_1$ and $m_2$, whereas $K = 1-2$.

1 Claim, 4 Drawing Sheets

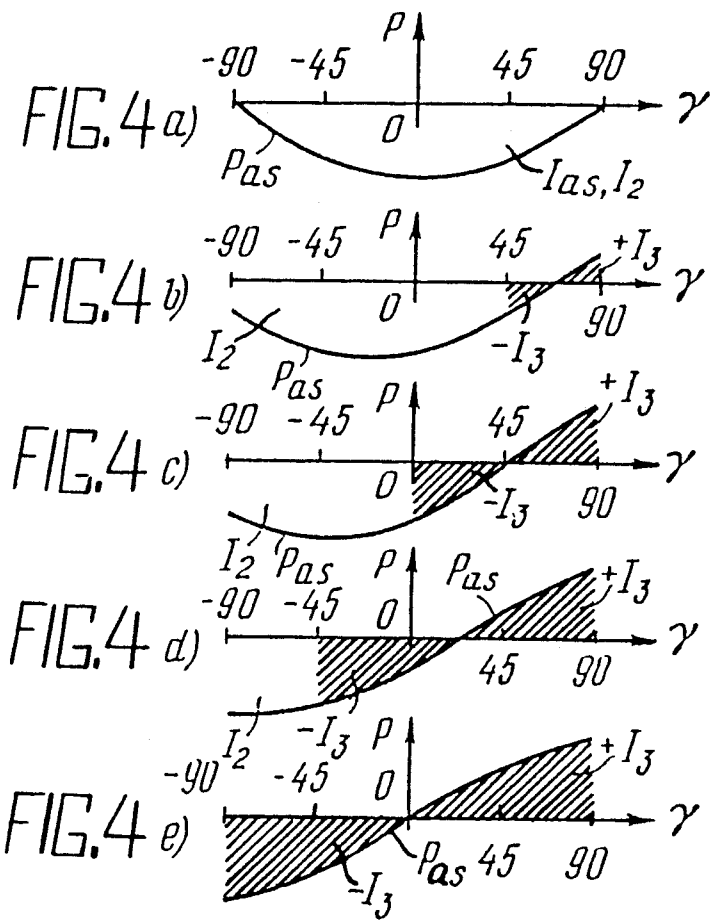
FIG. 4 a)
FIG. 4 b)
FIG. 4 c)
FIG. 4 d)
FIG. 4 e)
P
γ
-90
-45
0
45
90
$I_{as}, I_2$
$P_{as}$
$I_2$
$+I_3$
$-I_3$
$I_2'$
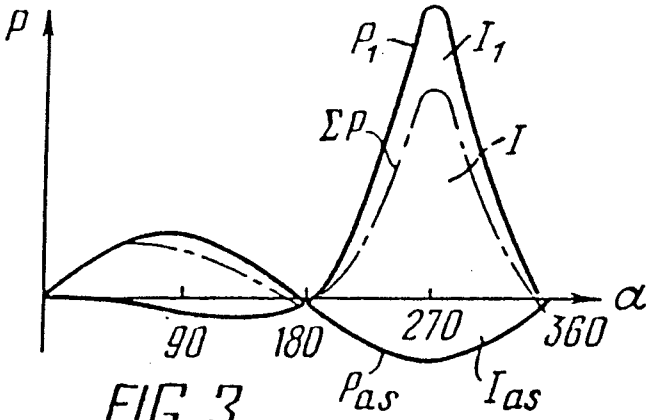
FIG. 3
P
α
90
180
270
360
$I_1$
$P_1$
$\Sigma P$
$-I$
$I_{as}$
$P_{as}$
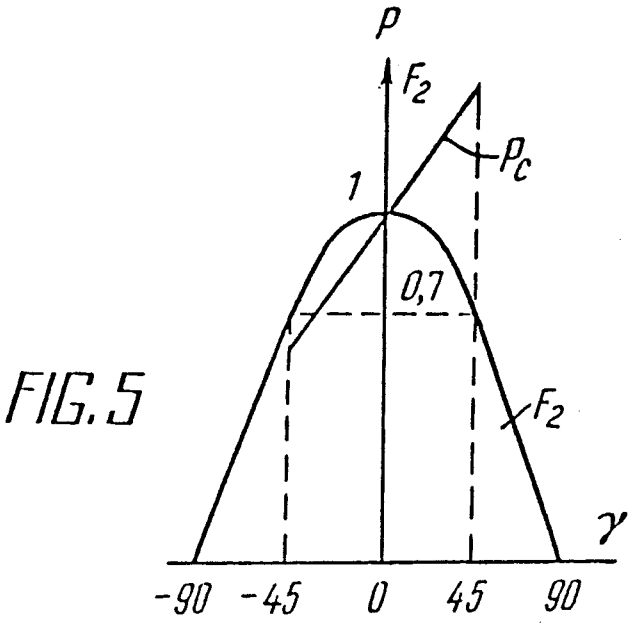
FIG. 5
P
γ
$F_2$
$P_c$
1
0,7
-90
-45
0
45
90

COMPRESSION-VACUUM PERCUSSIVE ACTION MACHINE

FIELD OF THE INVENTION

This invention relates to compression-vacuum percussive action machines.

Compression-vacuum percussive action machines normally have a piston and a hammer accommodated inside a cylinder and separated by an air cushion. The piston is connected to a drive shaft by way of a connecting rod and a crank, whereas the hammer is intended to engage with a work tool and reciprocates in phase coincidence with the piston.

With the aim of reducing the forces of recoil arising during the movement of the piston and hammer the crank is connected to the drive shaft through counterweight.

BACKGROUND OF THE INVENTION

There is known a compression-vacuum percussive action machine comprising a housing which accommodates a cylinder with a piston, a drive connected to the piston by a crank mechanism, and a hammer connected to the piston by way of an air cushion and engaging with a work tool (cf., DE, B, No. 2,407,879). In order to reduce vibration, the crank has a counterweight. The counterweight is positioned so that the forces of inertia arising as a result of rotation of the crank from the translational movement of the piston and counterweight are oppositely directed. Acting on the housing of the machine in counterphase, these forces balance each other, whereby vibration of the housing of the compression-vacuum machine is reduced. A disadvantage of this machine is high vibration of the housing corresponding to the frequency of movement of the hammer caused by a continuously varying pressure in the air cushion, as the forces caused by the pressure in the air cushion which varying in sign and magnitude are not balanced.

There is also known a compression-vacuum percussive action machine comprising a housing which accommodates a cylinder containing a hammer intended to engage with a work tool, and a piston separated from the hammer by an air cushion and capable of reciprocating inside the cylinder, a crank connected to the piston and linked with a drive by a counterweight whose centre of mass is offset relative to a straight line passing through the points of intersection of the axes of the drive shaft and crank with a plane perpendicular to the axis of the drive shaft (cf., J. E. Ivanov "Povyshenie nadezhnosti kompressionno-vakuumnykh otboinykh elektromolotkov", Ref. sbornik "Mekhanizirovanny instrument i otdelochnye mashiny", vypusk 3, 1967, NIIinfstroidorkommunmash, Moscow, pages 8 and 9).

In this compression-vacuum percussive action machine vibration caused by pressure forces periodically acting axially of the movement of the piston are reduced through compensating such forces by centrifugal forces of the asymmetrical counterweight. Displacement of the counterweight relative to the axis of the crank is such that the centrifugal force arising during rotation of the counterweight is directed in a counterphase to the maximum pressure force in the air cushion. This in turn reduces the action of the pressure forces exerted on the housing and brings down its vibration axially of the machine.

One disadvantage of the above machine resides in excessive vibration of the housing in a direction perpendicular to the travel path of the piston, because, as a rule, the pressure forces in the air cushion prevail over the forces of inertia of the reciprocating piston. Therefore, a counterweight of substantial mass is necessary to compensate for the forces of pressure in the air cushion. The centrifugal force of such a counterweight is not balance in a direction perpendicular to the travel path of the piston, which leads to high vibrations of the housing in this direction.

SUMMARY OF THE INVENTION

The present invention aims at providing a counterweight of a compression-vacuum percussive action machine which would be so constructed as to balance the forces of inertia of parts executing reciprocations and variable forces of pressure in the air cushion to result in bringing down vibrations imparted to the housing of the machine.

The aims of the invention are attained by that in a compression-vacuum percussive action machine comprising a housing which accomodates a cylinder containing a hammer intended to engage with a work tool, and a piston separated from the hammer by an air cushion and positioned inside the cylinder for reciprocations, a crank connected to the piston and linked with a drive shaft by a counterweight whose centre of mass is offset relative to a straight line passing through the points of intersection of the axes of the drive shaft and carnk with a plane perpendicular to the axis of the drive shaft, according to the invention, the projection of the counterweight plotted on this plane perpendicular to the axis of the drive shaft has a shape made up of two portions of which one is positioned in symmetry with the straight line passing through the points of intersection of the axes of the drive shaft and crank with the plane perpendicular to the axis of the drive shaft, whereas the centre of mass of the other portion rests at a line turned an angle of 45°–90° relative to said straight line in a direction of rotation of the crank, masses $m_1$ and $m_2$ of the parts of the counterweight corresponding to these portions of the shape being determined by the relationship:

$$m_1 r_1 = \frac{m_2 \cdot r_2}{K}$$

where $r_1$ and $r_2$ are the distances from the point of intersection of the axis of the drive shaft with a plane perpendicular to this axis to the centres of mass of the portions of the counterweight having respective mass $m_1$ and $m_2$, whereas $K = 1-2$.

With such an arrangement of the counterweight in the compression-vacuum percussive action machine vibration of the housing is reduced not only lengthwise of the travel path of the piston of the percussive mechanism, when the centrifugal force of the counterweight balances the force of pressure in the air cushion, but also in a direction perpendicular to the axis of the percussive mechanism. Displacement of the asymmetrical portion of the counterweight relative to its optimum position within a range of 45° resuslts in an insignificant increase in vibration of the housing of the machine axially of the percussive mechanism. If this displacement is such that the angle between the two portions of the counterweight grows, then the total vector of the centrifugal force of said portions of the counterweight is reduced to result in bringing down vibration of the machine in a direction perpendicular to the axis of the cylinder of the percussive mechanism.

Growth of vibration of the housing axially of the cylinder of the percussive mechanism in response to displacement of the asymmetrical portion of the counterweight from its optimum position takes place in a nonlinear manner. At the same time, variations in the magnitude of the total vector of the centrifugal force takes place linearly and in inverse proportion to the angle of offset, whereas the accompanying reduction in vibration in a direction perpendicular to the axis of the cylinder takes place faster than the growth of vibration axially of the cylinder. This in turn affords a general reduction in the level of vibration of the housing of the compression-vacuum percussive action machine.

BRIEF DESCRIPTION OF THE DRAWINGS

The invention will now be described in greater detail with reference to preferred embodiments thereof taken in conjunction with the accompanying drawings, in which:

FIG. 3 shows a graph of dependency of forces acting during the working cycle on the housing of the machine axially of the cylinder at the side of the percussive mechanism on the angle of turning of the crank;

FIG. 4 *a, b, c, d, e* shows a graph of dependency between the amplitude of the force pulse produced by the mass of the asymmetrical portion of the counterweight and the angle of offset of the counterweight;

FIG. 5 is a joint graph showing variations in the surface area $F_2$ of the substracted part of the force pulse produced by the mass of the asymmetrical portion of the counterweight as its centre of mass is offset from the optimum position, and variations in the magnitude of the total vector $P_c$ of the centrifugal force of the counterweight as the centre of mass "b" of the asymmetrical portion of the counterweight is offset from the optimum to an angle of $\pm 45°$, when the ratio between the centrifugal forces of asymmetrical and symmetrical portions of the counterweight is 1.5;

BEST MODE OF CARRYING OUT THE INVENTION

Figure 1:
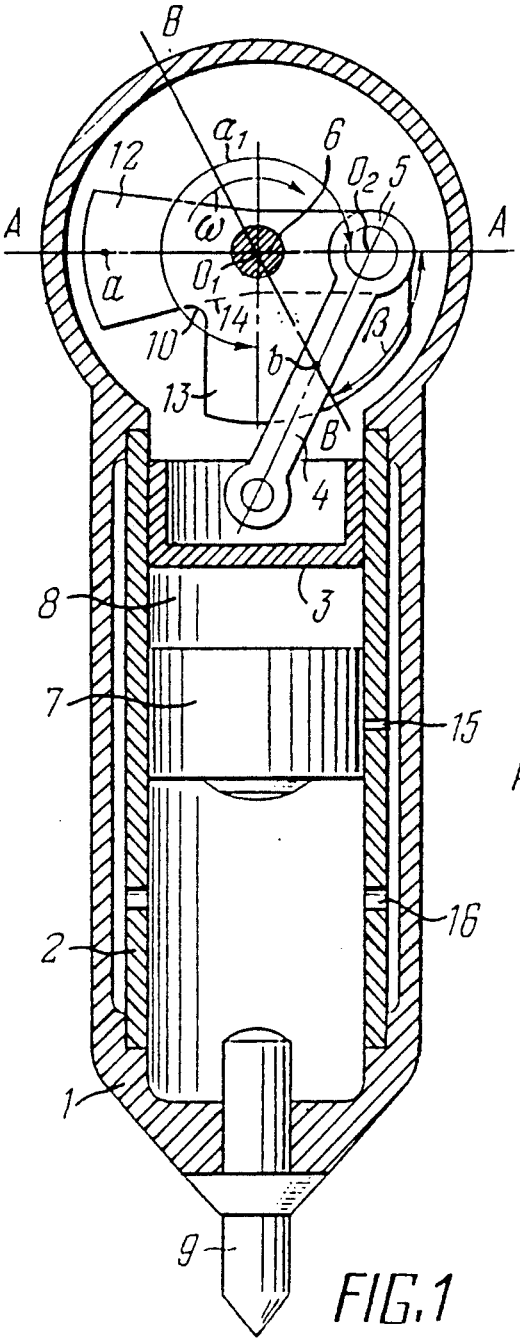
FIG. 1 is a longitudinal sectional view of a compression-vacuum percussive action machine according to the invention.

A compression-vacuum percussive action machine (FIG. 1) comprises a housing 1 accommodating a cylinder 2 having secured therein a piston 3 connected to a crank mechanism which includes a connecting rod 4 and a crank 5 to transmit movement from a drive shaft 6 of the drive (not shown). The cylinder 2 accommodates a reciprocating hammer 7 connected to the piston 3 by way of an air cushion 8 and periodically engaging with a work tool 9. The arrow $\omega$ shows direction of rotation of the crank 5. The angle $\alpha$ is the angle of turning of the crank 5 from the bottom dead centre of the piston 3 to a position at which the force $P_1$ (FIG. 2) of pressure in the air cushion 8 (FIG. 1) is the greatest.

The crank 5 is connected to the drive shaft 6 by a counterweight 10 (FIG. 1) whose projection on a plane perpendicular to the axis $O_1$ of the drive shaft 6 has a shape made up of portions 12, 13 separated by a dotted line 14. The portion 12 is symmetrical relative to the straight line A—A (FIG. 1) passing through the points of intersection of the axes $O_1$ of the drive shaft 6 and $O_2$ of the crank 5 with a plane perpendicular to the axis $O_1$ of the drive shaft 6 (the plane of the Figure), the center of mass "a" of this poriton resting at this straight line A—A.

The portion 13 has a centre of mass "b" resting at the line B—B (FIG. 1) at an angle $\beta$ to the straight line A—A. The angle $\beta$ is reckoned in the direction $\omega$ of rotation of the crank 5, and amounts to 45 -90°.

The cylinder 2 has relief holes 15 and idle stroke holes 16 to ensure normal operation of the compression-vacuum percussive action machine.

In the heretofore described construction of the counterweight 10 of the compression-vacuum percussive action machine its housing 1 is acted upon in the direction along the line of movement of the piston 3, or axially of the cylinder 2, during the working cycle for one full revolution of the crank 6 (360°) by the following time-variable forces (FIG. 2):

- $P_1$ —the force of pressure during compression of the air cushion 8;
- $P_p$ —the centrifugal force resuslting from the reciprocating piston 3;
- $P_c$ —the centrifugal force resulting from the mass of the counterweight 10 varying in a sinusoidal fashion;
- $P_s$ —the centrifugal force resulting from the mass of the portion 12 of the counterweight 10 varying sinusoidally and counterbalancing the force $P_p$;
- $P_{as}$ —the centrifugal force resulting from the mass of the portion 13 of the counterweight 10 varying sinusoidally and counterbalancing the force $P_1$.

The two latter forces $P_s$ and $P_{as}$ are components of the force $P_c$. The surface area limited by the curve of the pressure force $P_1$ and the axis of abscissa on which the angle $\alpha$ of turning of the crank 6 (FIG. 3) is plotted in degrees represents by a pulse $J_1$.

The surface area confined by a curve resulting from the variable force $P_a$ and the axis of abscissa is represented by a pulse $J_{as}$ acting in a counterphase to the pulse $J_1$.

When summing up the forces $P_1$ and $P_a$, the total component force $\Sigma P$ provides a force pulse J of a smaller surface area than the pulse $J_1$. Reduction in the surface area of the total pulse J is most pronounced in the strictly counterphase action of the forces $P_1$ and $P_{as}$ corresponding to the displacement of the centre of mass "b" of the asymmetrical portion 13 of the counterweight 10 to an angle $\beta$ of 90° (FIG. 4*a*).

A somewhat smaller reduction in vibration of the housing of the machine can be attained by displacing the centre of mass "b" of the poriton 13 of the counterweight 10 from the optimum, which is caused by a smaller surface area of the subtracted part $J_2$ of the pulse $J_{as}$ (FIGS. 4*b, c, d, e*) by virtue of the appearance of a positive pulse $J_3$ which is part of the pulse $J_{as}$. The maximum deviation of the angle from the optimum in response to a 30% reduction in the surface area $F_2$ of the subtracted pulse $J_2$ (FIG. 5) makes up the angle $\gamma = \pm 45°$.

Figure 6:
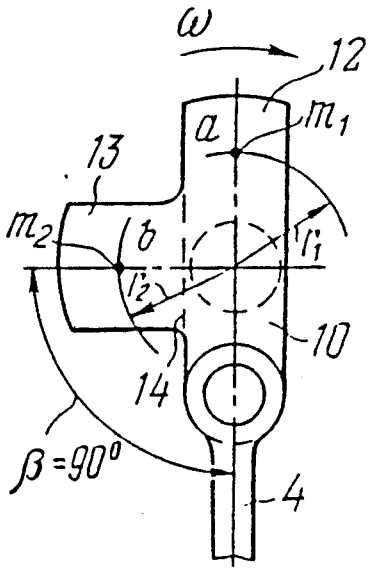
FIG. 6 shows a modified form of the counterweight with an asymmetrical portion positioned at an angle of offset $\beta = 90°$ relative to the centre of the crank, which the optimum for reducing vibration of the housing of the machine axially of the percussive mechanism.
Figure 8:
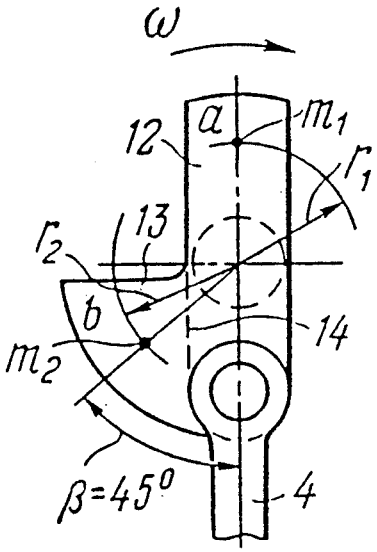
FIGS. 7 and 8 show alternative embodiments of the counterweight with an angle of offset of the asymmetrical portion of the counterweigfht toward increasing the angle between the two poritons of the counterweight.
Figure 7:
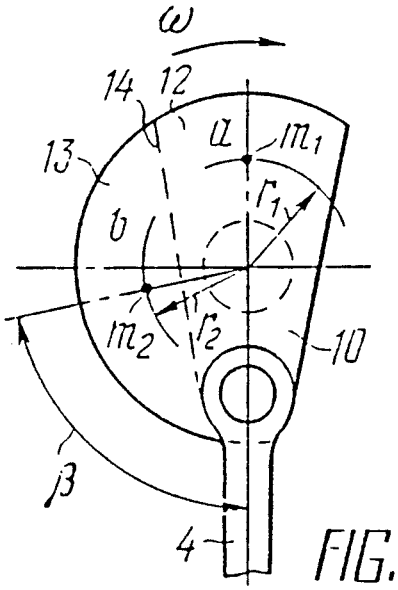
Figure 9:
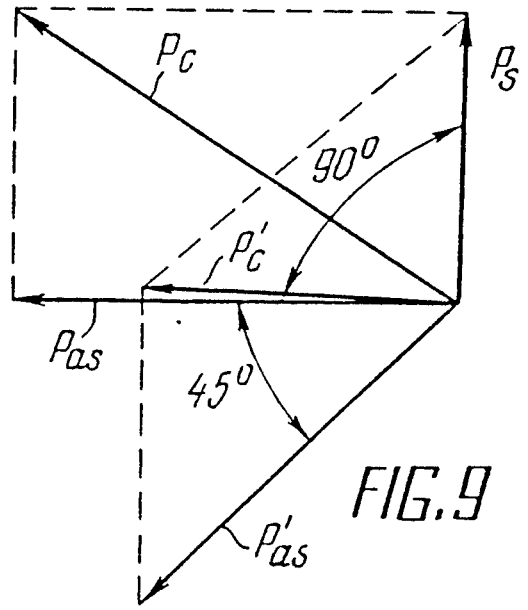
FIG. 9 shows a diagram of variations in the magnitude of the total vector $P_c$ to $P_c'$ in response to an increase in the angle between component vectors $P_s$ and $P_{as}$ to 135°.

The construction of the counterweight 10 ensuring minimized vibration of the housing of the machine axially of the cylinder 2 is shown in FIG. 6. In order to ensure that the maximum force $P_1$ and centrifugal force $P_{as}$ act in counterphase, the centre of mass "b" of the portion 13 of the counterweight 10 is offset relative to the axis of the crank 5 in the direction $\omega$ of rotation of the crank to the angle $\alpha$ of 90°. Reduction of the angle $\beta$ to 45° can be achieved by various structural arrangements of the counterweight 10 (FIGS. 7 and 8). Therewith, a difference in the mass of portions 12 and 13 can be attained either through varying their surface areas, or by providing different thickness of the counterweight 10 at these portions. Reducing the angle $\beta$ leads to an increase in the angle between the vectors $P_s$ and $P_{as}$ from 90° to 135°, and to a reduction in the total vector $P_c$ (FIG. 9). The extent to which the total vector $P_c$ is reduced in response to reducing the angle $\beta$ to 45° depends on the relationship $$K = \frac{m_2 r_2}{m_1 r_1}.$$

Figure 10:
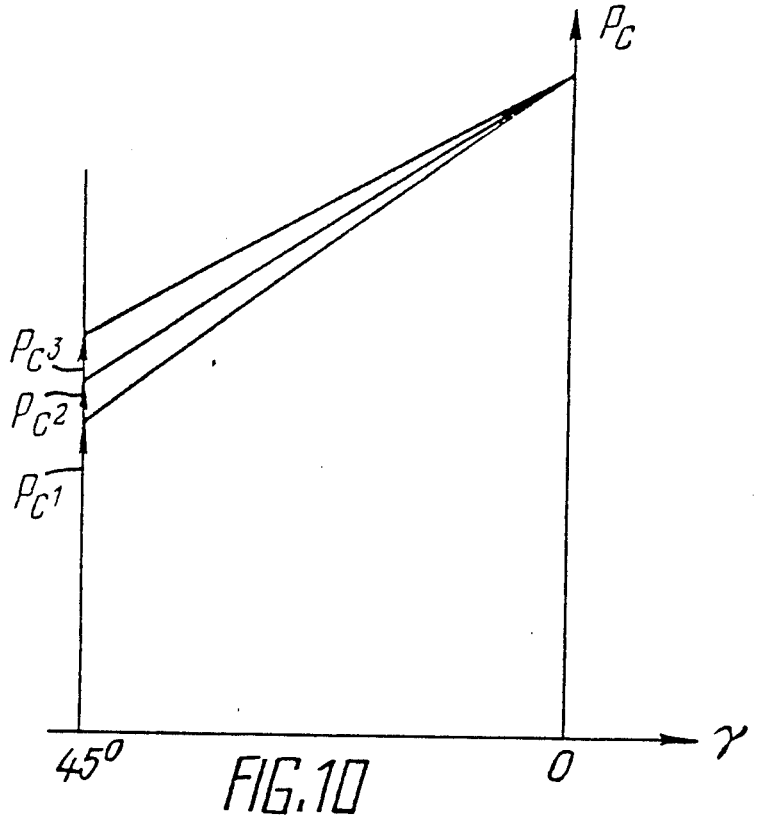
FIG. 10 shows a graph of variations in the total vector $P_c$ to magnitudes $P_c^1$, $P_c^2$, $P_c^3$ in response to an increase in the angle between component vectors of forces $P_s$ and $P_{as}$ at K equal to 1, 1.5 and 2.0, respectively.

The smaller is this relationship, the more pronounced is the reduction in the value of the total vector $P_c$ (FIG. 10).

The proposed compression-vacuum percussive action machine operates in the following manner. In the working or impact operation mode the movement of the crank 5, as caused by rotation of the drive shaft 6, is converted into reciprocations of the piston 3. The hammer 7 connected to the piston 3 by the air cushion 8 repeats the movements of the piston 3 to periodically engage with the work tool 9.

In the course of its movement from the bottom dead centre to the top dead centre (reverse stroke of the piston 3) the piston 3 develops an underpressure in the air cushion 8, thereby forcing the hammer 7 to follow its path. When then piston 3 moves from the top dead centre to the bottom dead centre (work stroke of the piston), the distance between the piston 3 and hammer 7 is reduced, and an overpressure is produced in the air cushion 8 causing the hammer 7 to change its travel path to move toward the work tool 9 to engagement therewith. A full revolution of the crank 5 forms an impact cycle following the frequency of impacts.

In the course of operation the housing 1 of the machine is acted upon axially of the cylinder 2, that is in line with the axis of the piston 3, by the following time-variable forces (FIG. 2): $P_1$, $P_{as}$, $P_p$, $P_s$ and $P_c$.

Through utilizing the superposition principle enabling to view oscillations and their effect on a body separately in terms of components it is possible to consider the forces $P_s$ and $P_{as}$ and the action they exert on the housing 1 of the machine separately.

One of the component forces, viz., the centrifugal component of the forces $P_s$ resulting from the mass of the symmetrical portion 12 of the counterweight 10 acting on a line extending through the center of mass "a" of the portion 12 of the counerweight 10 is at an angle 180° to the line A—A. The centrifugal force $P_s$ resulting from the mass of this portion 12 acts in a counterphase with the inertia force $P_p$ resulting from the translational movement of the piston 3.

The second component force caused by the counterweight 10 is the centrifugal force $P_{as}$ produced by the mass of the portion 13 of the counterweight 10 asymmetrical relative to the line A—A and applied to the centre of mass "b" of this portion 13 along a line positioned at an angle $\beta = 90° - 45°$ relative to the line A—A, whereby this force $P_{as}$ acts in a counterphase to the pressure force $P_1$. A variation in the force $P_1$ in time during the working cycle is pulsewise; however, in the course of compression of the air cushion 8 during the forward stroke of the piston 3 variation in the force $P_1$ is approximated by the positive half-wave of the sinusoid. The surface area confined by this half-wave and the axis of abscissa (FIG. 3) forms a pressure force pulse or impace pulse $J_1$. This impact pulse $J_1$ is the most substantial source of vibration compared to the pulses of all other forces acting on the housing 1 of the machine at the side of the air cushion 8 and crank mechanism. Reduction in the surface area of the impact pulse $J_1$ leads to a proportional reduction in the vibrations of the housing 1 of the compression-vacuum percussive action machine along the axis of the cylinder 2.

Reduced surface area of the impact pulse $J_1$ is attained by forming a pulse $J_{as}$ produced by the centrifugal force $P_{as}$ and acting in a counterphase with the impact pulse $J_1$. Taking into consideration the sinusoidal character of variations in the force $P_{as}$ (FIG. 3) and the near-sinusoidal nature of the force $P_1$ their action in a counterphase will be evidenced as these forces achieve their maximum value accompanied by their opposite direction. Therewith, the housing 1 of the machine is acted upon by a total pulse J equal to the algebraic sum of the two pulses $J_{as}$ and $J_1$ resuslting from the effect of the respective forces $P_{as}$ and $P_1$. In this case the surface area of the pulse $J_{as}$ is subtracted from the surface area of the pulse $J_1$, whereas the surface area of the total pulse J becomes smaller than the surface area of the pulse $J_1$ to eventually resuslt in reduced vibration of the housing 1. This positioning of the centre of mass "b" of the assymmetrical portion 13 of the counterweight 10 minimizes the surface area of the total pulse J to be the optimum from the point of view of reducing vibration from the force $P_1$ in a direction along the axis of the cylinder 2.

The effect of reduction in the surface area of the total pulse J is attained not only by the strictly counterphase action of the centrifugal force $P_{as}$, but also as a result of a shift of the maximum of this force and consequently of the centre of mass "b" from the optimum position to a certain angle $\gamma$. As the centre of mass "b" is shifted from the optimum position, the surface area of the pulse J (unhatched portion in FIG. 4) subtracted from the surface area of the impact pulse $J_1$ is reduced.

In the counterphase action of the pulses $J_1$ and $J_{as}$ the entire surface area of the pulse $J_{as}$ is subtracted from the surface area of the pulse $J_1$, whereby $J_2 = J_{as}$.

As the maximum force $P_{as}$ is displaced from its central position, part $J_3$ of the negative pulse $J_{as}$ (FIG. 4) present under the pulse $J_1$ becomes positive, and the surface area of the subtracted pulse $J_2$ is reduced, which determines the growth of the surface area of the total pulse J and, as a consequence, makes reduction in vibrations less pronounced.

Reduction in the surface area of the subtracted pulse $J_2$ accompanied by a departure of the maximum force $P_{as}$ from its optimum position to the angle $\gamma$ has a quadratic character in the form of a single-peak curve represented in FIG. 5, from which it can be seen that initially, as the maximum force $P_{as}$ is displaced from its central position, the large angles $\gamma$ provide a rather negligeable reduction in the surface area of the subtracted pulse $J_2$. However, an even small further increase in the angle $\gamma$ leads to a tangible reduction in the surface area of the substracted pulse $J_3$. Such phenomena are widespread in many industrial fields, such as radio engineering, where the passage of a radio signal through a resonant circuit is characterized by a certain bandwidth. Therewith, at the bandwidth edges the signal has a reduced strength equal to 0.7 the strength at the resonance frequency in the centre of the resonance curve peak. The 0.7 level is a boundary between the flat and steep portions of the resonance curve.

In view of the aforedescribed, in this case the 30% reduction in the surface area of the subtracted pulse $J_2$ corresponds to a deviation of the maximum force $P_{as}$ from its optimum position to an angle $\gamma$ equal to $\pm 45°$ corresponding to the deviation of the centre of mass "b" of the assymmetrical portion 13 of the counterweight 10 from its optimum position to the same angle of $\pm 45°$.

Figure 2:
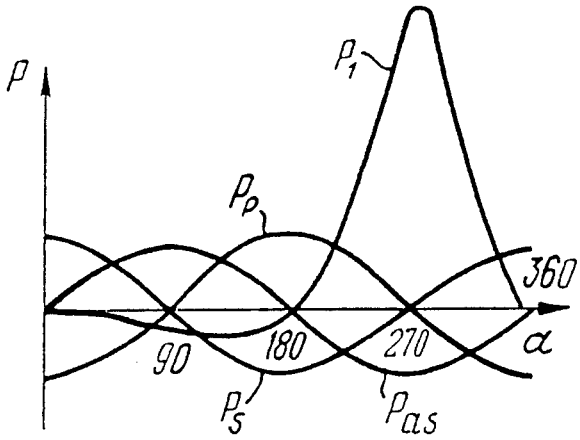
FIG. 2 shows graphs of forces acting on the housing of the proposed compression-vacuum percussive action machine during the working cycle in a direction axially of the cylinder at the side of the percussive and crank mechanisms.

The maximum value of the force $P_1$ in compression-vacuum percussive action machines is within the turning angle $\alpha$ of the crank 6 equal to 270° (FIG. 2). The counterphase action of the force $P_{as}$ relative to the force $P_1$ is effected when the centre of mass "b" of the assymmetrical portion 13 of the counterweight 10 is offset to an angle $\beta$ equal to $360° - \alpha$, which is $360° - 270° = 90°$ relative to the line A—A in the direction $\omega$ of rotation of the crank 5 (FIG. 1). At the same time, a possible offset of the centre of mass "b" relative to the line A—A in the direction $\omega$ of rotation of the crank 5 will be $\pm 45°$, which is within the range of magnitudes of the angle $\beta$ from 45° to 135°.

The counterweight 10 compensates for the force $P_1$ of inertia arising as a result of compression of the air cushion 8 and acting in line with the axis of the percussive mechanism, while at the same time being a source of oscillations of the housing of the machine in a direction perpendicular to the axis of the cylinder 2. The greater is the total vector of the centrifugal force $P_c$ of the counterweight 10, the higher is this vibration. In the herein proposed machine vibrations in a direction perpendicular to the axis of the cylinder 2 is reduced thanks to reduction in the magnitude of the total vector of the centrifugal force $P_c$ of the counterweight 10, which is a vector sum of the two centrifugal forces $P_s$ and $P_{as}$ determined by the diagonal line of a parallelogram as with sides equal to the vectors of forces $P_s$ and $P_{as}$. The greter is the angle between the vectors $P_s$ and $P_{as}$ making up the parallelogram, the smaller is the total vector $P_c$. In consequence, the greater is the angle between the portions 12 and 13 of the counterweight 10, the smaller is the magnitude of the vector $P_c$ (FIG. 9) and the smaller is vibration of the housing 1 in a direction perpendicular to the axis of the cylinder 2.

In order to attain the aforedescribed effect, the centre of mass "b" of the assymmetrical portion 13 of the counterweight 10 is offset toward reducing the angle $\beta$ by 45°. The range of possible magnitude of the angle $\beta$ is 90°-45°. Reduction in the magnitude of the total vector in response to reducing the angle $\beta$ in said range has a linear dependency (FIG. 10), where $\beta$ is the angle of inclination to the axis of abscissa depending on the relationship between the moments of inertia of the symmetrical portion 12 and asymmetrical portion 13 of the counterweight 10, that is on the relationship K. The practice of designing compression-vacuum percussive action machines shows that depending on the construction of the percussive mechanism the maximum of the force $P_1$ of pressure in the air cushion 8 amounts to (1-2) $P_p$. To compensate for these forces, the centrifugal forces of the portions 12 and 13 of the counterweight 10 must be within the same relationship. As the centre of mass "b" of the assymetrical portion 13 of the counterweight 10 is offset from its optimum position by 45°, the total vector is reduced by 46 -35% depending on the value of K (FIG. 10). Taking into account the different character of variations in the surface area of the substracted part of the force pulse provided by the asymmetrical portion 13 of the counterweight 10 and the total vector $P_c$ of the centrifugal force of the counterweight 10 during displacement of the center of mass "b" of its asymmetrical portion 13, it is always possible to find such a combination of the aforedescribed factors as to enable, without increasing vibration axially of the percussive mechanism, to substantially reduce it in a direction perpendicular to this axis, and therefore reduce general susceptibility of the machine to vibration. The aforedescribed effect is most pronounced when the values of the angle $\gamma$ of offset of the centre of mass "b" of the asymmetrical portion 13 is at the midrange of the possible values of the angle $\beta$. In this case the reduction in the subtracted part of the pulse amounts to a few percent, whereas the total vector $P_c$ is reduced by 20% (depending on the value of K).

In view of the foregoing, provision in the proposed compression-vacuum percussive action machine of a counterweight with two portions, viz., one symmetrical and the other asymmetrical with the line A—A, when the mass of these poritons is determined by the relationship:

$$m_1 r_1 = \frac{m_2 r_2}{K}$$

at K = 1-2, with the centre of mass of the assymmetrical portion of the counterweight being offset to an angle 45°-90° relative to the line A—A in the direction of rotation of the crank 5 affords, without increasing vibration axially of the cylinder, to substantially reduce it in a direction perpendicular to the axis of the cylinder, and therefore reduce the general susceptibility of the machine to vibration.

INDUSTRIAL APPLICABILITY

The invention can find application in civil engineering, mining, and other industrial fields for breaking materials and making holes.

We claim:

1. A compression-vacuum percussive action machine comprising a housing (1) which accommodates a cylinder containing a hammer (7) intended to engage with a work tool (9), and a piston (3) separated from the hammer (7) by an air cushion (8) and positioned inside the cylinder (2) for reciprocations, a crank pin (5) connected to the piston (3) and linked with a drive shaft (6) by a counterweight (10) whose centre of mass is offset relative to a straight line (A—A) passing through the points of intersection of the axes($O_1$ and $O_2$) of the drive shaft (6) and crank pin (5) in a plane perpendicular to the axis of the drive shaft (6), characterized in that a projection of the counterweight (10) plotted on this plane perpendicular to the axis ($O_1$) of the drive shaft (6) has a shape made up of two portions (12, 13) of which one (12) is positioned in symmetry with the straight line (A—A) passing through the points of intersection of the axes ($O_1$ and $O_2$) of the drive shaft (6) and crank pin (5) in a plane perpendicular to the axis ($O_1$) of the drive shaft (6), whereas the centre of mass ("b") of the other portion (13) rests at the line (B—B) turned at an angle ($\beta$) of 45°-90° relative to said straight line (A—A) in a direction ($\omega$) of rotation of the crank pin (5), masses $m_1$ and $m_2$ of the parts of the counterweight (10) corresponding to the portions (12, 13) of the shape being determined by the relationship:

$$m_1 r_1 = \frac{m_2 r_2}{K}$$

where $r_1$ and $r_2$ are the distances from the point of intersection of the axis ($O_1$) of the drive shaft (6) in a plane perpendicular to this axis ($O_1$) to the centres of mass (a, b) of the portions of the counterweight (10) having respective mass $m_1$ and $m_2$, whereas $K = 1\text{-}2$.

* * * * *